US005743237A

United States Patent [19]

Matta

[11] Patent Number: 5,743,237

[45] Date of Patent: Apr. 28, 1998

[54] HYDRAULICALLY-ACTUATED FUEL INJECTOR WITH NEEDLE VALVE OPERATED SPILL PASSAGE

[75] Inventor: George M. Matta, Peoria, Ill.

[73] Assignee: Caterpillar Inc., Peoria, Ill.

[21] Appl. No.: 788,494

[22] Filed: Jan. 28, 1997

[51] Int. Cl.[6] ..... F02M 37/04

[52] U.S. Cl. ..... 123/496; 123/506

[58] Field of Search ..... 123/446, 467, 123/496, 506; 239/533.1, 533.4, 533.5

[56] References Cited

U.S. PATENT DOCUMENTS

| | | | |
|---|---|---|---|
| 1,341,911 | 6/1920 | Keller . | |
| 2,053,312 | 9/1936 | Amery | 299/107.2 |
| 2,551,053 | 5/1951 | Rogers | 103/41 |
| 2,890,657 | 6/1959 | May et al. | 103/41 |
| 2,896,856 | 7/1959 | Kravits | 239/132 |
| 3,115,304 | 12/1963 | Humphries | 239/90 |
| 4,200,231 | 4/1980 | Knape | 239/94 |
| 4,224,903 | 9/1980 | Mowbray | 123/300 |
| 4,258,883 | 3/1981 | Hofmann et al. | 239/124 |
| 4,306,681 | 12/1981 | Laitio et al. | 239/89 |
| 4,315,603 | 2/1982 | Nakajima et al. | 239/533.3 |
| 4,412,657 | 11/1983 | Mowbray | 239/533.9 |
| 4,715,540 | 12/1987 | Miyake | 239/533.3 |
| 4,741,478 | 5/1988 | Teerman et al. | 239/88 |
| 4,838,233 | 6/1989 | Hayashi et al. | 123/506 |
| 4,840,310 | 6/1989 | Haider | 239/533.4 |
| 4,928,886 | 5/1990 | Kronberger | 239/533.5 |
| 4,984,738 | 1/1991 | Winquist | 239/88 |
| 5,020,500 | 6/1991 | Kelly | 123/496 |
| 5,029,568 | 7/1991 | Perr | 123/506 |
| 5,082,180 | 1/1992 | Kubo et al. | 239/88 |
| 5,094,397 | 3/1992 | Peters et al. | 239/88 |
| 5,125,580 | 6/1992 | Kronberger | 239/533.4 |
| 5,125,581 | 6/1992 | Kronberger | 239/533.5 |
| 5,429,309 | 7/1995 | Stockner | 239/533.8 |
| 5,445,323 | 8/1995 | Perr et al. | 239/91 |
| 5,487,508 | 1/1996 | Zuo | 239/533.5 |
| 5,492,098 | 2/1996 | Hafner et al. | 123/506 |
| 5,505,384 | 4/1996 | Camplin | 239/533.5 |
| 5,526,791 | 6/1996 | Timmer et al. | 123/467 |
| 5,526,792 | 6/1996 | Guth et al. | 123/467 |

FOREIGN PATENT DOCUMENTS

| | | |
|---|---|---|
| 0 255 350 | 2/1988 | European Pat. Off. . |
| 3 117 665 | 11/1982 | Germany . |
| 3 900 762 | 7/1990 | Germany . |
| 52 21530 | 2/1977 | Japan . |
| 2 86953 | 3/1990 | Japan . |
| 1 201 544 | 12/1985 | U.S.S.R. . |
| 2 140 081 | 11/1984 | United Kingdom . |
| 2 157 366 | 10/1985 | United Kingdom . |
| 2 230 559 | 10/1990 | United Kingdom . |

*Primary Examiner*—Thomas N. Moulis
*Attorney, Agent, or Firm*—Liell & McNeil

[57] ABSTRACT

A hydraulically-actuated fuel injector includes an injector body that defines an actuation fluid cavity, a piston bore, a plunger bore, a nozzle chamber and a nozzle outlet that opens to the nozzle chamber. A piston is slidably received in the piston bore and moveable between an upper position and a lower position. A plunger is slidably positioned in the plunger bore and moveable between a retracted position and an advanced position. A portion of the plunger and the plunger bore define a fuel pressurization chamber that opens to the nozzle chamber. The injector body further defines a nozzle supply passage extending between the fuel pressurization chamber and the nozzle chamber, a spill passage extending between the nozzle supply passage and the nozzle chamber, and a fuel return passage opening into the nozzle chamber. A needle valve member is positioned in the nozzle chamber and moveable a distance between an open position in which the nozzle outlet is open and a closed position in which the nozzle outlet is blocked. The needle valve member blocks the spill passage and the fuel return passage when the needle valve member is in its open position and when it is in its closed position. However, an annulus in the needle valve member opens the spill passage to the fuel return passage over a portion of the travel distance of the needle valve member between its open position and its closed position.

15 Claims, 3 Drawing Sheets

HYDRAULICALLY-ACTUATED FUEL INJECTOR WITH NEEDLE VALVE OPERATED SPILL PASSAGE

TECHNICAL FIELD

The present invention relates generally to hydraulically-actuated fuel injectors, and more particularly to such injectors having a rate shaping spill passage incorporated into the operation of the needle valve.

BACKGROUND ART

Fuel injection rate shaping is a process of tailoring the initial portion of fuel delivery to control the amount of fuel delivered during the ignition delay portion and the main injection portion of an injection cycle. This process modifies the heat release characteristics of the combustion process and is beneficial in reducing undesirable emissions and noise levels from the engine.

Caterpillar Inc.'s U.S. Pat. No. 5,492,098 on a Flexible injection Rate Shaping Device For A Hydraulically-Actuated Fuel Injection System describes an apparatus for variably controlling the fuel flow characteristics of a hydraulically-actuated fuel injector during an injection cycle. This injector generally accomplishes front end rate shaping by spilling fuel over a portion of the plunger's initial downward stroke during an injection event. The opening of the spill port causes a lowering of fuel pressure during the initial portion of the injection event so that less fuel leaves the nozzle outlet of the injector. Performance of the rate shaping aspects of the injector are primarily controlled by the geometry of the spill passage and the plunger movement rate during the initial portion of the injection event. While hydraulically-actuated fuel injectors of this type have performed magnificently for many years, it is not always desirable to incorporate the fuel spilling features into the plunger and barrel assembly of the injector.

Generally, the incorporation of the rate shaping spill passage into the plunger and barrel assembly is desirable since the plunger begins its downward stroke from the same retracted position regardless the amount of fuel to be injected. However, when fill metering features are incorporated into a hydraulically-actuated fuel injector, the plunger begins its downward stroke from a different position depending upon the amount of fuel to be injected. In other words, between injection events, the plunger retracts only as far as is necessary to draw into the fuel pressurization chamber the precise amount of fuel to be injected in the next injection event. Consequently, a fixed initial geometry between the plunger and barrel is not readily possible, making the incorporation of a spill passage significantly more problematic.

The present invention is directed to overcoming one or more of the problems as set forth above.

DISCLOSURE OF THE INVENTION

A hydraulically-actuated fuel injector includes an injector body that defines an actuation fluid cavity, a piston bore, a plunger bore, a nozzle chamber and a nozzle outlet that opens to the nozzle chamber. A piston is slidably received in the piston bore and moveable between an upper position and a lower position. A plunger is slidably positioned in the plunger bore and moveable between a retracted position and an advanced position. A portion of the plunger and the plunger bore define a fuel pressurization chamber that opens to the nozzle chamber. The injector body further defines a nozzle supply passage extending between the fuel pressurization chamber and the nozzle chamber, a spill passage extending between the nozzle supply passage and the nozzle chamber, and a fuel return passage opening into the nozzle chamber. A needle valve member is positioned in the nozzle chamber and moveable a distance between an open position in which the nozzle outlet is open and a closed position in which the nozzle outlet is blocked. The needle valve member blocks the spill passage and the fuel return passage when the needle valve member is in its open position and when it is in its closed position. However, the spill passage is open to the fuel return passage over a portion of the distance the needle valve member moves between its open position and its closed position.

In a fill metered embodiment of the present invention, the hydraulically-actuated fuel injector also includes means for stopping the plunger at a metered position between its retracted position and its advanced position when the plunger is retracting from its advanced position.

In still another embodiment of the present invention, a fuel injection system includes a hydraulically-actuated fuel injector of a type substantially described previously. In addition, the injector includes an actuation fluid inlet that is connected to a source of high pressure actuation fluid via a first supply passage. The injector also includes a fuel supply passage connected to a source of fuel fluid different from the actuation fluid via a second supply passage. The injector also includes an actuation fluid drain that is connected to a low pressure actuation fluid reservoir via a drain passage. A control valve is positioned in the actuation fluid cavity of the injector and capable of moving between a first position in which the actuation fluid inlet is open and the actuation fluid drain is closed, and a second position in which the actuation fluid inlet is closed and the actuation fluid drain is open. Finally, the fuel injection system includes a computer in communication with and capable of controlling the control valve.

One object of the present invention is to provide rate shaping in a hydraulically-actuated fuel injector.

Another object of the present invention is to provide an improved hydraulically-actuated fuel injector.

Still another object of the present invention is to provide improved rate shaping characteristics in a hydraulically-actuated fuel injection system.

BEST MODE FOR CARRYING OUT THE INVENTION

Figure 1:
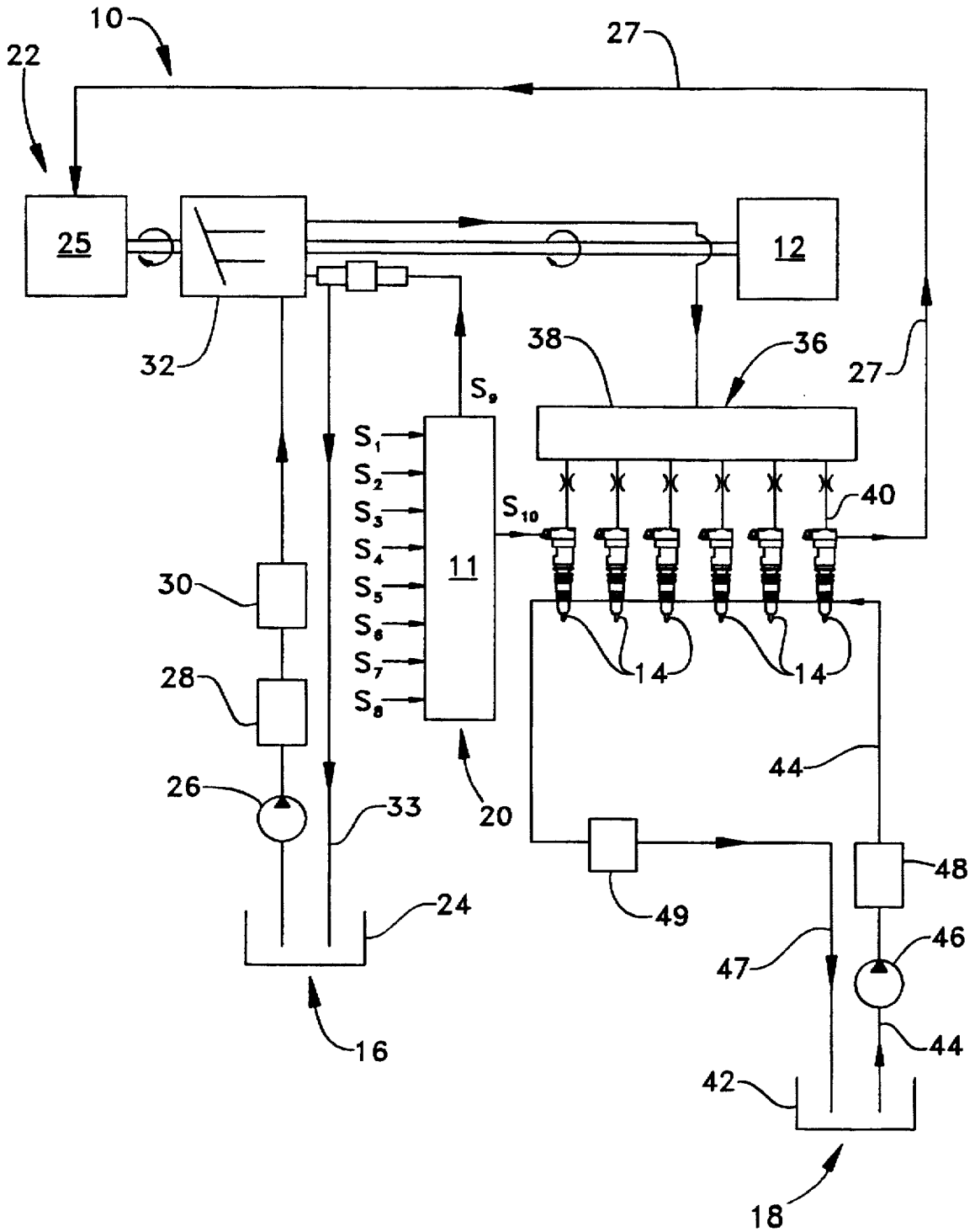
FIG. 1 is a schematic illustration of a hydraulically actuated fuel injection system according to one embodiment of the present invention.

Referring now to FIG. 1, there is shown an embodiment of a hydraulically-actuated electronically controlled fuel injection system 10 in an example configuration as adapted for a direct injection diesel cycle internal combustion engine 12. Fuel system 10 includes one or more hydraulically-actuated electronically controlled fuel injectors 14, which are adapted to be positioned in a respective cylinder head bore of engine 12. Fuel system 10 includes an apparatus or means 16 for supplying actuating fluid to each injector 14, an apparatus or means 18 for supplying fuel to each injector, a computer 20 for electronically controlling the fuel injection system, and an apparatus or means 22 for recirculating actuation fluid and for recovering hydraulic energy from the actuation fluid leaving each of the injectors.

The actuating fluid supply means 16 preferably includes an actuating fluid sump 24, a relatively low pressure actuating fluid transfer pump 26, an actuating fluid cooler 28, one or more actuation fluid filters 30, a high pressure pump 32 for generating relatively high pressure in the actuation fluid and at least one relatively high pressure actuation fluid manifold 36. A common rail passage 38 is arranged in fluid communication with the outlet from the relatively high pressure actuation fluid pump 32. A rail branch passage 40 connects the actuation fluid inlet 50 (FIG. 2) of each injector 14 to the high pressure common rail passage 38.

Actuation fluid leaving the actuation fluid drain 51 (see FIG. 2) of each injector 14 enters a recirculation line 27 that carries the same to the hydraulic energy recirculating or recovering means 22. A portion of the recirculated actuation fluid is channeled to high pressure actuation fluid pump 32 and another portion is returned to actuation fluid sump 24 via a recirculation line 33.

Any available engine fluid is preferably used as the actuation fluid in the present invention. However, in the preferred embodiments, the actuation fluid is engine lubricating oil and the actuation fluid sump 24 is an engine lubricating oil sump. This allows the fuel injection system to be connected directly into the engine's lubricating oil circulation system. Alternatively, the actuation fluid could be provided by a fuel tank 42 or another source, such as coolant fluid, etc.

The fuel supply means 18 preferably includes a fuel tank 42, a fuel supply passage 44 arranged in fluid communication between fuel tank 42 and the fuel inlet 77 (FIG. 2) of each injector 14, a relatively low pressure fuel transfer pump 46, one or more fuel filters 48, a fuel supply regulating valve 49, and a fuel circulation and return passage 47 arranged in fluid communication between injectors 14 and fuel tank 42.

The computer 20 preferably includes an electronic control module 11 which controls (1) the fuel injection timing; (2) the total fuel injection quantity during an injection cycle; (3) the fuel injection pressure; (4) the number of separate injections or injection segments during each injection cycle; (5) the time intervals between the injection segments; (6) the fuel quantity of each injection segment during an injection cycle; (7) the actuation fluid pressure; and (8) any combination of the above parameters. Computer 20 receives a plurality of sensor input signals $S_1$–$S_8$, which correspond to known sensor inputs, such as engine operating condition, load, etc., that are used to determine the precise combination of injection parameters for a subsequent injection cycle. In this example, computer 20 issues a control signal $S_9$ to control the actuation fluid pressure and a control signal $S_{10}$ to control the actuation fluid control valve within each injector 14. Each of the injection parameters are variably controllable independent of engine speed and load. In the case of injector 14, control signal $S_{10}$ represents current to the solenoid 57 (FIG. 2) commanded by computer 20.

Figure 2:
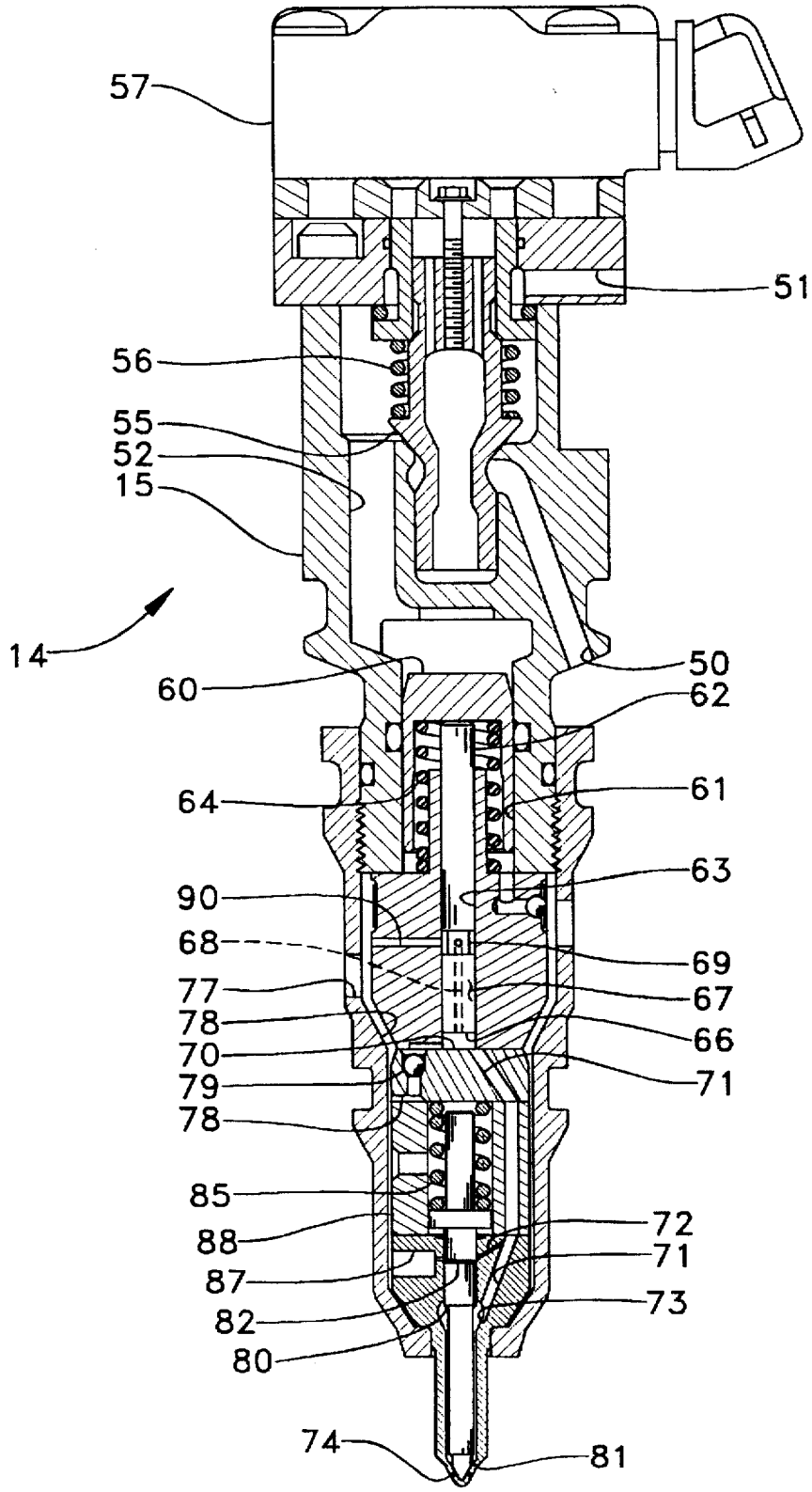
FIG. 2 is a sectioned side elevational view of a hydraulically-actuated fuel injector according to another embodiment of the present invention.

Referring now to FIG. 2, hydraulically-actuated fuel injector 14 includes an injector body 15 made up of various components attached to one another in a manner well known in the art. Injector body 15 defines an actuation fluid cavity 52 that is open to a piston bore 61, a high pressure actuation fluid inlet 50 and a low pressure actuation fluid drain 51. A control valve includes a poppet valve member 55 that is attached to and moved by a solenoid 57. A compression spring 56 normally biases poppet valve member 55 to its lower seated position which closes actuation fluid cavity 52 to actuation fluid inlet 50. When in this position, actuation fluid cavity 52 is opened to low pressure actuation fluid drain 51. When solenoid 57 is energized, poppet valve member 55 is lifted from its lower seated position to an upper seated position which simultaneously closes low pressure actuation fluid drain 51 and opens actuation fluid inlet 50 to actuation fluid cavity 52. Each injection event is initialized by energizing solenoid 57 to permit high pressure actuation fluid to flow into actuation fluid cavity 52 to act on the upper surface of an intensifier piston 60.

Intensifier piston 60 is positioned to reciprocate in piston bore 61 between an upper position and a lower position, as shown. Injector body 15 also defines a plunger bore 63 that slidably receives a plunger 62. Plunger 62 reciprocates between a retracted position and an advanced position as shown. A compression return spring 64 normally biases piston 60 and plunger 62 to their respective upper and retracted positions. Plunger 62 includes an end face 66 and a side surface 67. An annulus 69 is machined in the side surface 67, and a pressure relief passage 68 extends between end face 66 and annulus 69. A portion of plunger bore 63 and plunger 62 define a fuel pressurization chamber 70.

Fuel enters injector 14 through a fuel inlet 77 and then travels along a fuel supply passage 78, past ball check 79 and into fuel pressurization chamber 70, when plunger 62 and piston 60 are undergoing their return stroke between injection events. Ball check valve 79 prevents the back flow of fuel from fuel pressurization chamber 70 into fuel supply passage 78 when plunger 62 and piston 60 are undergoing their downward stroke during an injection event.

Injector body 15 also defines a nozzle chamber 73 that opens to a nozzle outlet 74. Nozzle chamber 73 is connected to fuel pressurization chamber 70 via a nozzle supply passage 71. During an injection event, fuel flows from fuel pressurization chamber 70, through nozzle supply passage 71 into nozzle chamber 73 and eventually out of nozzle outlet 74. A needle valve member 80 is positioned to reciprocate in nozzle chamber 73 between an open position in which nozzle outlet 74 is open and a closed position, as shown in which nozzle outlet 74 is blocked. A biasing spring 85 normally biases needle valve member 80 to its closed position. However, when fuel pressure within nozzle chamber 73 exceeds a valve opening pressure, the hydraulic force acting on lifting surface(s) 81 causes the needle valve member to lift against the action of biasing spring 85 to its open position.

Figure 3:
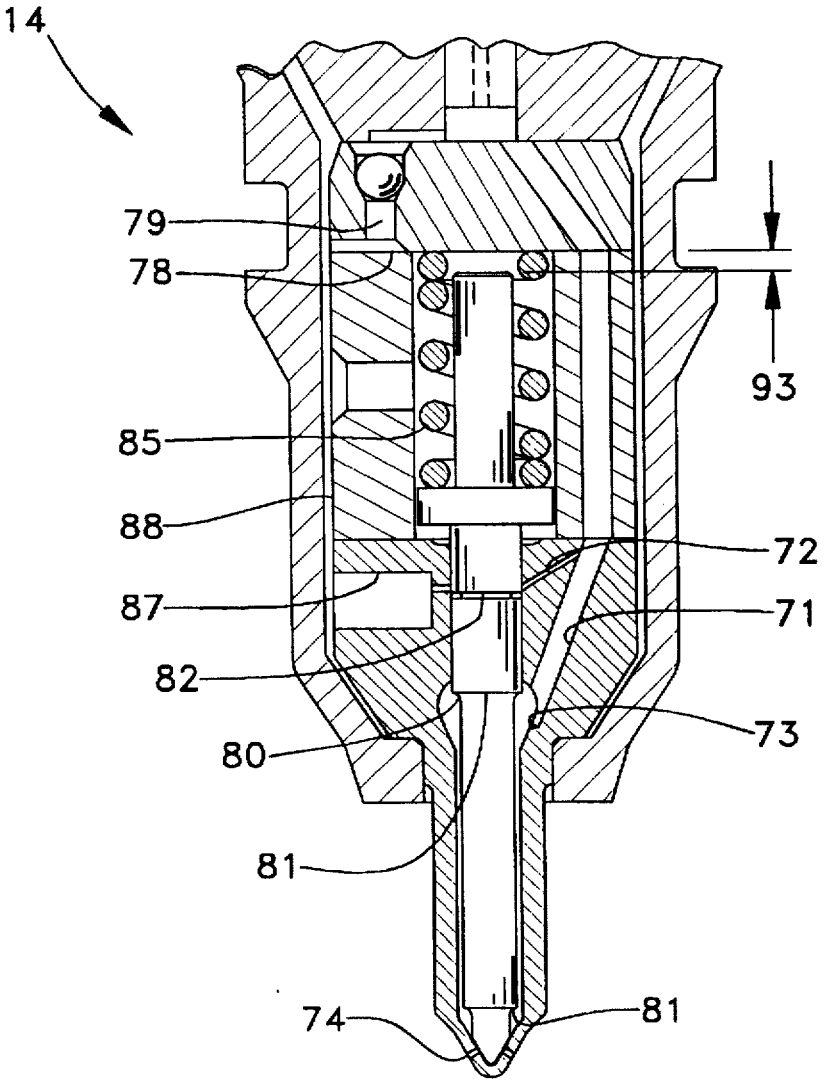
FIG. 3 is a partially sectioned side elevational view of the needle valve member area of the fuel injector shown in FIG. 2.

Referring now to FIG. 3, needle valve member 80 includes an annulus 82. Injector body 15 also defines a spill passage 72 extending between nozzle supply passage 71 and nozzle chamber 73. Injector body 15 also includes a fuel return passage 87 that opens to fuel inlet 77 (FIG. 2) via an annular passage 88. When needle valve member 80 is in its closed position, as shown, it blocks both spill passage 72 and fuel return passage 87. Likewise, when needle valve member 80 has moved the complete distance to its fully open position, the side surface of needle valve member 80 also blocks spill passage 72 and fuel return passage 87. However, when needle valve member is moving between its closed and open positions, annulus 82 briefly opens spill passage 72 to fuel return passage 87.

Because the total movement distance 93 of needle valve member from its closed position to its open position is a distance preferably on the order of about one-half of a millimeter, the annulus height is preferably on the order of about 0.20 millimeters. The diameter of spill passage 72 is preferably on the order of about 0.20 millimeters, and the lead distance that the needle valve member must travel before annulus 82 opens spill passage 72 to fuel return passage 87 is preferably on the order of about 0.1 millimeters. In any event, the total of the annulus height, the diameter of spill passage 72 and the lead distance should be about equal to or just less than the total possible movement distance 93 of needle valve member 80. This dimensioning insures that the spill passage 72 is closed or blocked by needle valve member 80 when it is in its closed position and in its open position.

A portion of fuel return passage 87 is a control volume many times larger than the combined volume of annulus 82 and spill passage 72. This relatively large volume is intended to reduce potential cavitation problems that might otherwise occur because of the relatively small flow area that exists when annulus 82 opens spill passage 72 to fuel return passage 87. The brief opening of spill passage 72 when needle valve member is moving from its closed position to its open position allows an amount of fuel to spill into fuel return passage 87, thus reducing the injection rate at the initial portion of each injection event. This produces a desirable rate shaping effect that reduces undesirable emissions and noise from the engine.

INDUSTRIAL APPLICABILITY

Each injection event is initiated by computer 20 commanding solenoid 57 to be energized in order to open actuation fluid inlet 50 to actuation fluid cavity 52. When this occurs, high pressure actuation fluid begins to flow into actuation fluid cavity 52 acting on the top surface of intensifier piston 60, starting it to move downward. This in turn causes plunger 62 to begin its downward stroke. Fuel pressure within fuel pressurization chamber 70 begins to rise and eventually reaches a valve opening pressure sufficient to overcome needle return spring 85. As needle valve member 80 begins to lift, fuel begins to exit nozzle outlet 74. However, as needle valve member 80 continues to move upward toward its fully open position, annulus 82 briefly opens spill passage 72 to fuel return passage 87. A portion of the fuel from nozzle supply passage 71 then flows through spill passage 72, annulus 82 and into fuel return passage 87, rather than flowing into nozzle chamber 73 and out of nozzle outlet 74. Thus, the amount of fuel flowing into nozzle chamber 73 is reduced and the fuel pressure in nozzle chamber 73 is also briefly reduced. Both of these effects cause a lowering of the injection mass flow rate out of nozzle outlet 74, resulting in desirable front end rate shaping to the injection profile.

As plunger 62 continues its downward movement, needle valve member 80 likewise continues its upward movement toward its fully open position. When in its fully open position, spill passage 72 is again blocked so that fuel pressure in nozzle chamber 73 quickly resumes its maximum rated pressure, and the main injection portion of each injection sequence commences.

Eventually, plunger 62 reaches a position in which annulus 69 opens to a pressure relief passage 90, which extends between plunger bore 63 and fuel inlet 77. When this occurs, the fuel pressure in fuel pressurization chamber 70 and nozzle chamber 73 is quickly released through pressure relief passage 68, causing needle valve member 80 to return to its closed position under the action of biasing spring 85. This ends the injection event. It should be noted, however, that the solenoid 57 continues to be energized so that actuation fluid inlet 50 continues to be open, causing piston 60 and plunger 62 to continue their downward movement until they reach the end of their stroke.

The solenoid 57 remains energized holding piston 60 and plunger 62 in their respective lower and advanced positions until the refilling mode begins. The computer then determines the amount of time necessary to allow a desired amount of fuel to enter injector 14 before it is time to initialize the next injection event. The refilling mode is commenced by de-energizing solenoid 57 so that actuation fluid cavity 52 is once again open to low pressure actuation fluid drain 51. This allows return spring 64 to begin retracting plunger 62 and piston 60. Fuel is then drawn into fuel inlet 77, through fuel supply passage 78 and past ball valve member 79 into fuel pressurization chamber 70. When the precise amount of fuel has been metered into the injector and the time for the next injection event has come, solenoid 57 is again energized to open high pressure actuation fluid inlet 50. This causes plunger 62 and piston 60 to briefly stop at a metered position somewhere between their respective advanced and retracted positions. The flow of high pressure actuation fluid 50 again flows into actuation fluid cavity 50 to initiate the next injection event.

Those skilled in the art will appreciate that by properly sizing spill passage 72 and annulus 82 as well as positioning the two with respect to one another in view of the movement of needle valve member 80, front end rate shaping can be accomplished through the spillage of a desired amount of fuel toward the beginning of each injection event. In some instances, they can be sized sufficiently large to produce split injection. Those skilled in the art will also appreciate that a port passageway could be substituted for annulus 82, and/or an annulus could be formed in the injector body as a portion of spill passage 72, without altering the rate shaping performance of the injector. Other objects and advantages of the present invention can be gained by a review of the attached drawings, the claims and the above specification.

I claim:

1. A hydraulically actuated fuel injector comprising:

an injector body that defines an actuation fluid cavity, a piston bore, a plunger bore, a nozzle chamber and a nozzle outlet that opens to said nozzle chamber;

a piston slidably received in said piston bore and moveable between an upper position and a lower position;

a plunger slidably positioned in said plunger bore and moveable between a retracted position and an advanced position;

a portion of said plunger and said plunger bore defining a fuel pressurization chamber that opens to said nozzle chamber;

said injector body further defining a nozzle supply passage extending between said fuel pressurization chamber and said nozzle chamber, a spill passage extending between said nozzle supply passage and said nozzle chamber, and a fuel return passage opening into said nozzle chamber;

a needle valve member positioned in said nozzle chamber and moveable a distance between an open position in which said nozzle outlet is open and a closed position in which said nozzle outlet is blocked; and said needle valve member blocking said spill passage and said fuel return passage when said needle valve member is in said open position and said closed position, but said spill passage being open to said fuel return passage over a portion of said distance between said open position and said closed position.

2. The hydraulically actuated fuel injector of claim 1 wherein said needle valve member includes an annulus that opens said spill passage to said fuel return passage over a portion of said distance between said open position and said closed position.

3. The hydraulically actuated fuel injector of claim 2 wherein said spill passage and said annulus have a combined volume; and said fuel return passage includes a control volume many times larger than said combined volume.

4. The hydraulically actuated fuel injector of claim 3 wherein said distance is about one half millimeter; and said annulus has a height less than one third millimeter.

5. The hydraulically actuated fuel injector of claim 4 wherein said injector body further includes an actuation fluid inlet and a fuel inlet;

said fuel inlet is connected to a source of fuel; and said actuation fluid inlet is connected to a source of actuation fluid different from said source of fuel.

6. A hydraulically actuated fuel injector comprising:

an injector body having an actuation fluid cavity that opens to an actuation fluid inlet, an actuation fluid drain and a piston bore, and having a plunger bore that opens to a fuel supply passage and a nozzle chamber, and said nozzle chamber opens to a nozzle outlet, and further having a pressure relief port that opens into said plunger bore;

a control valve mounted in said injector body and being movable between a first position that opens said actuation fluid inlet and closes said actuation fluid drain, and a second position that closes said actuation fluid inlet and opens said actuation fluid drain;

a piston positioned to reciprocate in said piston bore between an upper position and a lower position;

a plunger having a side surface and an end face, and being positioned to reciprocate in said plunger bore between an advanced position and a retracted position, and said plunger further including pressure relief passage extending between said end face and said side surface;

a portion of said plunger bore and said plunger defining a fuel pressurization chamber that opens to said nozzle chamber;

said injector body further defining a nozzle supply passage extending between said fuel pressurization chamber and said nozzle chamber, a spill passage extending between said nozzle supply passage and said nozzle chamber, and a fuel return passage opening into said nozzle chamber;

a valve positioned in said fuel supply passage and being operable to prevent flow of fuel from said fuel pressurization chamber back into said fuel supply passage;

a needle valve member positioned to reciprocate in said nozzle chamber between a closed position that blocks said nozzle outlet and an open position that opens said nozzle outlet;

means, within said injector body, for biasing said needle valve member toward said closed position;

means for stopping said plunger at a metered position between said retracted position and said advanced position when said plunger is retracting from said advanced position; and said needle valve member blocking said spill passage and said fuel return passage when said needle valve member is in said open position and said closed position, but said spill passage being open to said fuel return passage over a portion of said distance between said open position and said closed position.

7. The hydraulically actuated fuel injector of claim 6 wherein said needle valve member includes an annulus that opens said spill passage to said fuel return passage over a portion of said distance between said open position and said closed position.

8. The hydraulically actuated fuel injector of claim 7 wherein said spill passage and said annulus have a combined volume; and said fuel return passage includes a control volume many times larger than said combined volume.

9. The hydraulically actuated fuel injector of claim 8 wherein said distance is about one half millimeter; and said annulus has a height less than one third millimeter.

10. The hydraulically actuated fuel injector of claim 9 wherein said injector body further includes an actuation fluid inlet and a fuel inlet;

said fuel inlet is connected to a source of fuel; and said actuation fluid inlet is connected to a source of actuation fluid different from said source of fuel.

11. A fuel injection system comprising:

a source of high pressure actuation fluid;

a low pressure actuation fluid reservoir;

a source of fuel fluid different from said actuation fluid;

a hydraulically actuated fuel injector comprising: an injector body that defines a fuel supply passage, a nozzle chamber that opens to a nozzle outlet and a plunger bore, and a pressure relief port that opens into said plunger bore;

hydraulic means within said injector body for pressurizing fuel in said nozzle chamber that includes a plunger with an end face and a side surface, and said plunger being positioned in said plunger bore and moveable a stroke distance between a retracted position and an advanced position;

a needle valve member positioned in said nozzle chamber and moveable between an open position in which said nozzle outlet is open and a closed position in which said nozzle outlet is blocked;

said plunger including a pressure relief passage extending between said end face and said side surface;

said injector body further defining a nozzle supply passage extending between said fuel pressurization chamber and said nozzle chamber, a spill passage extending between said nozzle supply passage and said nozzle chamber, and a fuel return passage opening into said nozzle chamber;

said needle valve member blocking said spill passage and said fuel return passage when said needle valve member is in said open position and said closed position, but said spill passage being open to said fuel return passage over a portion of said distance between said open position and said closed position; and a first supply passage connecting said actuation fluid inlet to said source of high pressure actuation fluid;

a second supply passage connecting said fuel supply passage to said source of fuel fluid different from said actuation fluid;

a drain passage connecting said actuation fluid drain to said low pressure actuation fluid reservoir;

a control valve positioned in said actuation fluid cavity and capable of moving between a first position in which said actuation fluid inlet is open and said actuation fluid drain is closed, and a second position in which said actuation fluid inlet is closed and said actuation fluid drain is open; and a computer in communication with and capable of controlling said control valve.

12. The fuel injection system of claim 11 wherein said needle valve member includes an annulus that opens said spill passage to said fuel return passage over a portion of said distance between said open position and said closed position.

13. The fuel injection system of claim 12 wherein said spill passage and said annulus have a combined volume; and said fuel return passage includes a control volume many times larger than said combined volume.

14. The fuel injection system of claim 13 wherein said distance is about one half millimeter; and said annulus has a height less than one third millimeter.

15. The fuel injection system of claim 14 further comprising means for stopping said plunger at a metered position between said retracted position and said advanced position when said plunger is retracting from said advanced position.

* * * * *